US005320521A

United States Patent [19]

Bussu

[11] Patent Number: 5,320,521

[45] Date of Patent: Jun. 14, 1994

[54] SELF-CONTAINED NIGHT LIGHT WITH INCORPORATED LIQUID FUEL AND WICK

[76] Inventor: Nissim Bussu, 223, rue des Pyrénées, Paris, France

[21] Appl. No.: 81,022

[22] Filed: Jun. 22, 1993

[30] Foreign Application Priority Data

Jun. 24, 1992 [FR] France ..... 92 07715

[51] Int. Cl.[5] ..... F23D 3/24

[52] U.S. Cl. ..... 431/320

[58] Field of Search ..... 431/320

[56] References Cited

U.S. PATENT DOCUMENTS 4,781,577 11/1988 Stewart ..... 431/320

*Primary Examiner*—Carroll B. Dority

*Attorney, Agent, or Firm*—Scully, Scott, Murphy & Presser

[57] ABSTRACT

The invention relates to a night light with incorporated liquid fuel and wick.

The night light is in the form of a hermetically sealed ampule comprising a bulging body (1), closed at its lower end by a base (5) enabling positioning of the ampule on standard supports, such as candleholders of different diameters, and extended at its upper end by a closed breakable neck (8), said ampule receiving a dose of liquid fuel (7) and a wick (6) at the time of manufacture, said wick (6) extending over the entire height of the body and neck and being held in position by a contraction (4) of the neck.

4 Claims, 1 Drawing Sheet

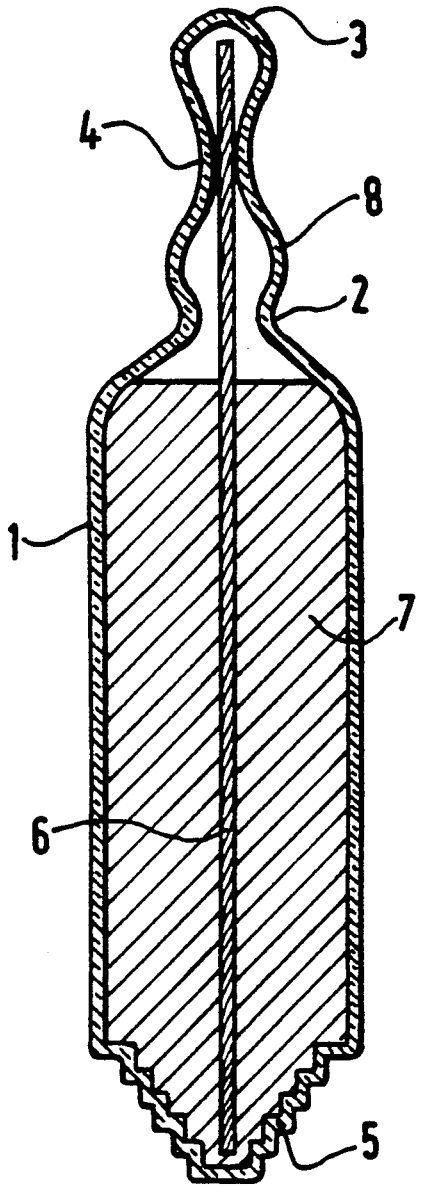
3
4
8
2
1
7
6
5

SELF-CONTAINED NIGHT LIGHT WITH INCORPORATED LIQUID FUEL AND WICK

The present invention relates to a night light with incorporated liquid fuel, such as oil, and wick.

To light an oil night light it has hitherto been necessary to have a suitable receptacle into which the oil has to be poured as well possibly as water to raise the layer of oil substantially to the level of the opening in the receptacle, and then a wick supported by a float has to be immersed in the receptacle.

However, preparation of such a night light takes a relatively long time, is impractical and often leads to the obtainment of a flame of mediocre quality, since it is difficult to regulate the length of wick which has to be immersed in the fuel and that which has to project out. Moreover, such a night light cannot be moved without caution, since the liquids which it contains are likely to overflow.

Moreover, a fuel receptacle is known from DE-36 00 608 which is closed at one end and the other end of which receives a conical metal cover ending at its end in a small diameter tube. Before the cover is fixed, the receptacle is filled with a high viscosity liquid fuel, such as wax or paraffin. A wick immersed in the liquid passes through said tube, where it is held by projections resulting from a granulation formed by way of the lateral wall of the tube. The tightness of the receptacle is obtained by immersing the end of the tube in a bath of hot solid wax. There is then formed about the tube a layer of wax which, in solidifying, forms a sealing stopper.

However, the tightness of such a receptacle is imperfect since the wax stopper is at risk of melting or being accidentally torn off. Moreover, the conical cover is at risk of becoming detached from the receptacle.

A lamp is also known from U.S. Pat. No. 4,511,952 which comprises an incorporated wick. However, this lamp is not ready for use, since the oil has to be introduced therein. Moreover, this lamp is not sealed, since it comprises an open orifice for the introduction of the oil.

The present invention remedies these disadvantages by proposing a hermetically sealed night light which is ready for use and combines in one unit all the ingredients necessary for combustion.

To this end, the night light according to the invention is in the form of a hermetically sealed ampule comprising a bulging body closed at its lower end by a base of graduated section enabling the ampule to be positioned in various standard supports, such as candleholders of different diameters, and extended at its upper end by a closed breakable neck, said ampule receiving at the time of manufacture a dose of liquid fuel and a wick, the latter extending over the whole height of the body and the neck and being held in position by a contraction in the neck.

At the time of use, it suffices to break the neck and release the end of the wick from the contraction. The wick may then be lit without any other handling. A good quality flame is thus obtained the life of which depends on the capacity of the ampule.

An embodiment of the invention will now be described with reference to the single attached FIGURE which shows a sectional view of the closed night light.

The night light is in the general shape of a pharmaceutical ampule and comprises a bulging body 1, for example cylindrical, which is extended at one end by a neck 8. The latter may be broken at its base along a rupture line 2 and ends in a closed tip 3 which exhibits a contraction 4 above the rupture line 2.

At its other end the body 1 ends in a base which may be flat, so that the night light can be placed on a flat support, or have a profile of decreasing section, for example stepped 5, so the night light can be adapted to supports of varying diameter.

At the time of manufacture the night light receives a dose of liquid fuel 7, such as oil, up to a level slightly below that of the rupture line 2 and a wick 6. The latter extends over the entire height of the body and the neck. Its upper end is pinched by the contraction 4, in such a way that there is no risk of the wick falling to the bottom of the night light body during transportation thereof and when it is being handled prior to opening.

The body and the neck are made in a single piece, preferably of transparent or translucent material, for example glass or a thermoplastic material. At the time of manufacture, after the night light has been filled with liquid fuel and had the wick positioned in it, the neck is closed by heating its tip to melting point, which enables it to be welded together and enables good hermetic sealing of the night light to be achieved.

It goes without saying that the night light according to the invention may assume different appearances, shapes and colours and may contain diverse types of liquid fuel giving a good flame. Another interesting application is that of aromatic oils which, when burning, give off a pleasant odour.

I claim:

1. A night light with liquid fuel, such as oil, characterized in that it is in the form of a hermetically sealed ampule comprising a bulging body (1), closed at its lower end by a base (5) enabling positioning of the ampule on standard supports, such as candleholders of different diameters, and extended at its upper end by a closed breakable neck (8), said ampule receiving a dose of liquid fuel (7) and a wick (6) at the time of manufacture, said wick (6) extending over the entire height of the body and neck and being held in position by a contraction (4) of the neck.

2. A night light according to claim 1, characterized in that the liquid fuel fills the body up to a level slightly below that of the rupture line (2) of the neck.

3. A night light according to claim 1, characterized in that the base is flat.

4. A night light according to claim 1, characterized in that the base is of graduated section.

* * * * *